US005325827A

United States Patent [19]

Fasola

[11] Patent Number: 5,325,827

[45] Date of Patent: Jul. 5, 1994

[54] STARTING SYSTEM FOR AN INTERNAL COMBUSTION ENGINE

[75] Inventor: Giancarlo Fasola, Milan, Italy

[73] Assignee: Industrie Magneti Marellui SpA, Milan, Italy

[21] Appl. No.: 34,155

[22] Filed: Mar. 22, 1993

[30] Foreign Application Priority Data

Mar. 24, 1992 [IT] Italy ..... T092 A 000249

[51] Int. Cl.[5] ..... F02N 11/08

[52] U.S. Cl. ..... 123/179.3; 290/38 R

[58] Field of Search ..... 123/179.3, 179.4, 179.2; 290/38 R, 38 C

[56] References Cited

U.S. PATENT DOCUMENTS 3,712,283 1/1973 Kiess et al. ..... 123/179.3

4,045,062 8/1977 Disosway, III et al. ..... 290/38 R

OTHER PUBLICATIONS

Abstract from "Soviet Inventions Illustrated," section PQ, Week 9202, Feb. 26, 1992, SU1643772A, Derwent Publications Ltd.

Abstract from "Patent Abstracts of Japan," vol. 9, No. 38, Feb. 19, 1985, JP-A-59-180064.

*Primary Examiner*—Andrew M. Dolinar

*Attorney, Agent, or Firm*—Edward D. Manzo

[57] ABSTRACT

The system includes a direct-current voltage supply, an electric starter motor for rotating a movable pinion, and an electromagnetic operating device which, when it receives an excitation current, moves the pinion to couple it for rotation with a rotary member of the internal combustion engine. In operation, an electronic control unit cuts off the current supply to the electromagnetic operating device as soon as the speed of rotation of the engine shaft exceeds a predetermined threshold and the acceleration of the shaft is less than or equal to zero.

1 Claim, 3 Drawing Sheets

STARTING SYSTEM FOR AN INTERNAL COMBUSTION ENGINE

The present invention relates to a starting system for an internal combustion engine, including:

a direct-current voltage supply, an electric starter motor for rotating a movable pinion, an electromagnetic operating device including a solenoid and an associated movable core which, as a result of the passage of a current through the solenoid, can bring about:

a movement of the pinion towards a working position in which it can be coupled for rotation with a rotary member of the internal combustion engine, and the supply of current to the electric motor, sensor means for supplying an electrical signal indicative of the speed of rotation of the shaft of the internal combustion engine, and control means for controlling the connection of the electromagnetic operating device to the voltage supply, the control means including comparator means which are arranged to compare the signal supplied by the sensor means with a predetermined threshold which corresponds to the speed at which the internal combustion engine can keep itself running.

Starting systems for internal combustion engines of this type are described, for example, in the prior Italian patent applications TO91A000485 and TO91A000781.

The object of the invention is to provide a starting system of the type indicated above, in which the pinion is disengaged from the rotary member of the internal combustion engine more easily and quietly than in the systems of the prior art.

According to the invention, this object is achieved by means of a starting system of the type specified above, the main characteristic of which lies in the fact that the control means are arranged:

to derive a signal indicative of the angular acceleration of the shaft of the internal combustion engine from the signal supplied by the sensor means, and to cut off the current supply to the solenoid of the electromagnetic operating device, in operation, as soon as the speed of rotation of the engine shaft exceeds the threshold and the angular acceleration of the shaft is less than or equal to zero.

Figure 1:
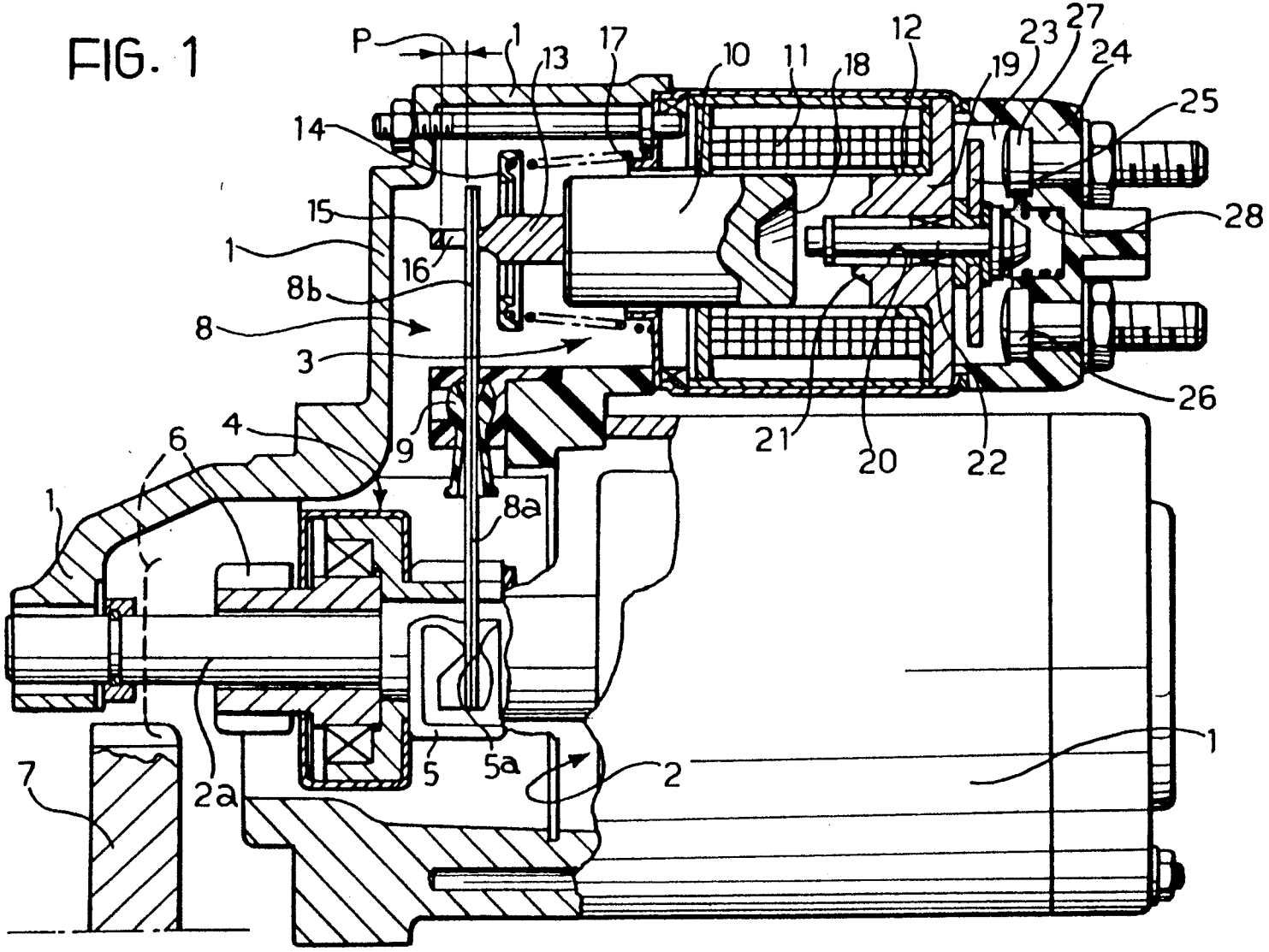
Figure 2:
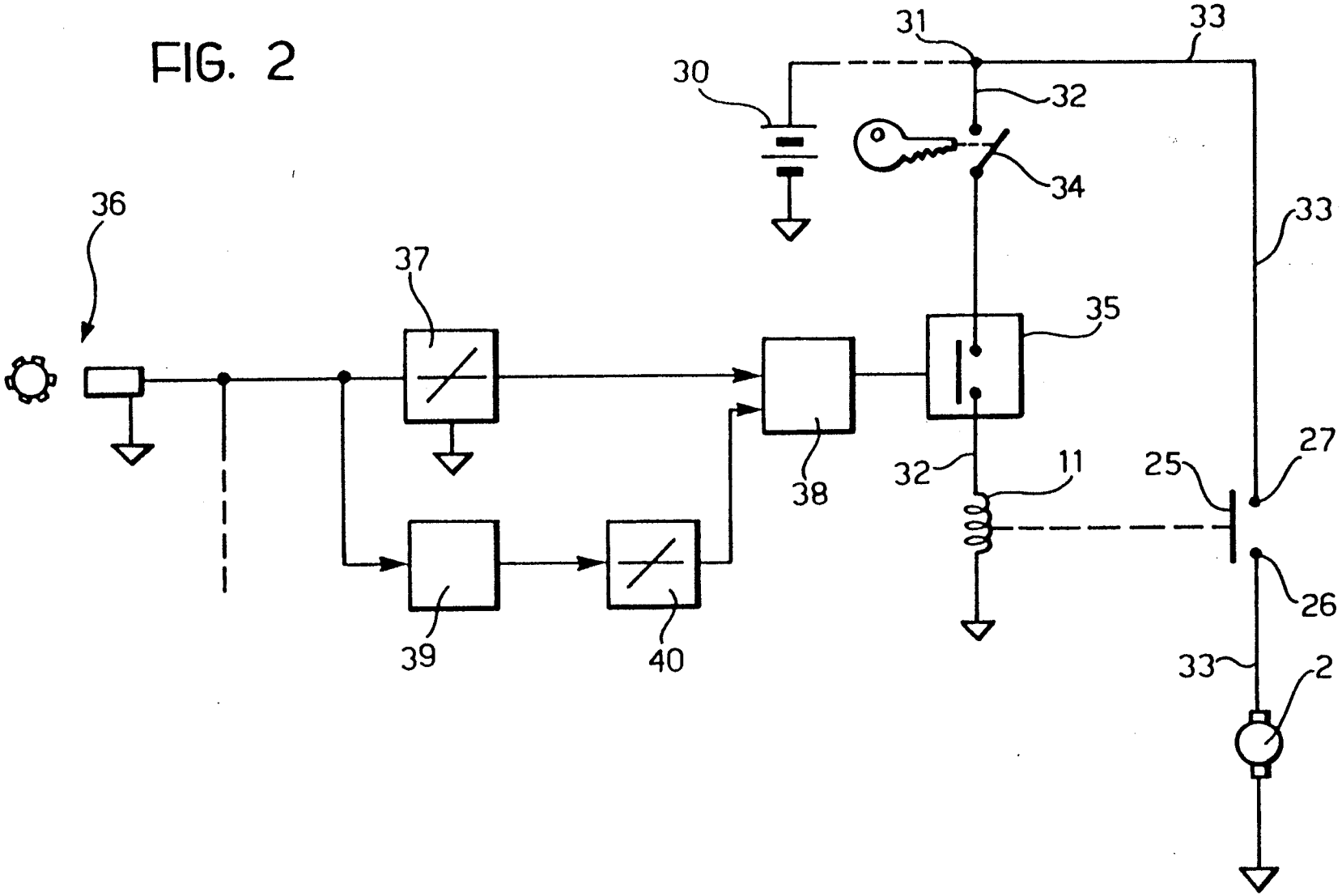
Figure 3:
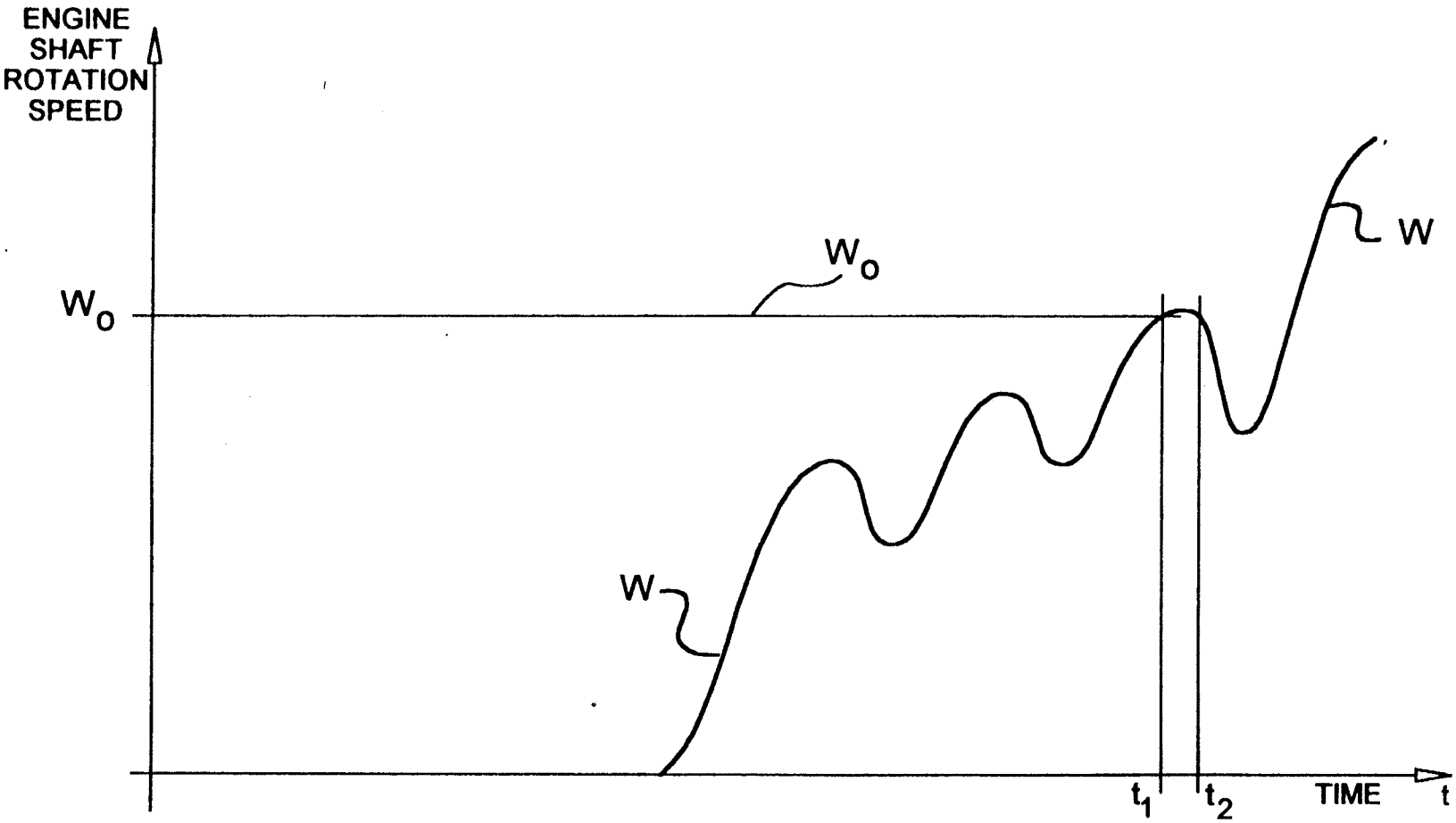

Further characteristics and advantages of the invention will become clear from the detailed description which follows with reference to the appended drawings, supplied purely by way of non-limiting example, in which:

FIG. 1 is a partially-sectioned side view of a starting unit for an internal combustion engine according to the prior art, FIG. 2 is a circuit diagram, partially in block form, of a starting system according to the invention, and FIG. 3 is a graph showing, by way of example, a curve of the angular velocity of the shaft of the internal combustion engine as a function of the time t, shown on the abscissa.

With reference to FIG. 1, a starting device for an internal combustion engine for motor vehicles includes a support casing 1 in which an electric drive motor 2 and an electromagnet 3 are mounted in a known arrangement.

In the arrangement shown, an overrunning (freewheel) coupling 4 is mounted on the shaft of the electric motor 2.

A sleeve 5 is movable on the shaft of the motor 2, together with the coupling 4.

A pinion 6 connected to the side of the coupling 4 which faces away from motor 2 is movable along part of an end portion 2*a* of the shaft of the electric motor 2. In particular, the pinion can move between a retracted, rest position, shown in continuous outline in FIG. 1, and an advanced, operating position, shown in broken outline.

In its operating position, the pinion 6 can mesh with the teeth of a flywheel 7 of the internal combustion engine (not shown).

A rocker arm, indicated 8, which can pivot about a fulcrum 9, acts as a transmission member between the sleeve 5 (which acts as a member for moving the pinion 6) and the core 10 of the electromagnet 3.

The electromagnet 3 includes an operating winding or solenoid 11 carried by a spool 12. The movable core 10 is movable axially within the spool.

One end of the core has an axial extension 13 around which a plate 14 is fixed. The end of the extension 13 has an appendage 15 with a slot 16 through which one end 8*b* of the rocker arm 8 extends.

A helical spring 17, which reacts against the plate 14, keeps the core 10 in the position shown, in which it projects partially from the operating winding or solenoid 11.

The end of the core 10 opposite the extension 13 has a frusto-conical recess 18.

A fixed core, generally indicated 19, is fitted in the end of the spool 12 of the electromagnet which faces away from the arm 8. The fixed core has a passage 20 coaxial with the spool 12 and the core 10. One end of the passage opens in the centre of a frusto-conical projection 21 of the fixed core 19, the projection facing and being complementary in shape to the recess 18 in the movable core 10.

A rod 22 movable axially in the passage 20 has an end which extends into a region 23 defined between the fixed core 19 of the electromagnet and a substantially cup-shaped insulating body 24. This end of the rod 22 carries a contact member (a movable contact) 25 which can cooperate with a pair of fixed contacts 26 and 27 in the form of screws, carried by the end wall of the insulating element 24.

At rest, a spring 28 interposed between the insulating body 24 and the end head of the rod 22 keeps the rod 22 in the position shown, in which its other end extends towards the movable core 10 and projects beyond the projection 21 of the fixed core 19. In this condition, the movable contact 25 is separated from the fixed contacts 26 and 27.

The movable contact and the associated fixed contacts together constitute an electrical switch which controls the supply of current to the electric motor 2 (in known manner).

When an excitation current is supplied to the operating solenoid 11 of the electromagnet 3, the core 10 is subjected to a force which moves it towards the fixed core 19. This movement causes the pinion 6 similarly to be moved towards the ring gear 7 of the internal combustion engine by the rocker arm 8.

As the movable core 10 continues to move, it brings the movable contact 25 into engagement with the fixed contacts 26 and 27. The electric motor 2 is consequently activated.

The known starting unit described above with reference to FIG. 1 constitutes part of a starting system of which a block diagram is shown in FIG. 2.

In this drawing, parts and elements already described with reference to FIG. 1 have been indicated by the reference numerals used above.

In FIG. 2, the battery of a motor vehicle with an internal combustion engine (not shown) is indicated 30.

In the embodiment illustrated, the negative pole of the battery 30 is connected to earth and its positive pole is connected to a junction 31. Two circuit branches, indicated 32 and 33, extend from this junction.

The branch 32 includes a manually-operable switch 34 which is incorporated, for example, in a conventional ignition and starting switch operable by means of a key.

In series with the switch 34 is a controlled electronic switch 35 such as, for example, a transistor.

The winding or solenoid 11 of the electromagnet 3 of FIG. 1 is connected between the electronic switch 35 and earth.

The fixed contacts 26 and 27 of FIG. 1 are connected in the circuit branch indicated 33 in FIG. 2. The electric motor 2 is also disposed in the circuit branch 33, between the fixed contact 26 and earth.

In FIG. 2, a sensor for outputting an electrical signal indicative of the speed of rotation (the number of revolutions per minute) of the internal combustion engine is generally indicated 36.

The sensor is of a known type, for example, of the so-called phonic-wheel type, and may, for example, be the sensor generally used to supply data regarding the rate of revolution of the engine to the electronic unit which controls the ignition and/or the fuel injection of the internal combustion engine.

The sensor 36 is connected to the input of a threshold comparator circuit 37 with hysteresis, the output of which is connected to the input of a control logic circuit 38.

The output of the sensor 36 is also connected to the input of a bypass circuit 39. In operation, this circuit outputs a signal indicative of the angular acceleration of the shaft of the internal combustion engine to a comparator 40.

The comparator circuit 37 supplies the control logic circuit 38 with an enabling signal when the speed of rotation of the shaft of the internal combustion engine exceeds a predetermined threshold which corresponds to the speed at which the internal combustion engine can keep itself running.

The comparator circuit 40 supplies the control logic circuit 38 with an enabling signal or consent when the angular acceleration of the shaft of the internal combustion engine is less than or equal to zero.

The starting system described above with reference to FIGS. 1 and 2 operates in the following manner.

In order to start the internal combustion engine, the switch 34 is closed.

The comparator circuit 37 supplies the logic circuit 38 with a signal indicative of the fact that the speed of rotation of the shaft of the internal combustion engine is less than the speed at which the engine can keep itself running. The logic circuit 38 accordingly enables current to flow through the electronic switch 35. A current flows through the solenoid 11 of the electromagnet 3 and, as a result of the movement of the associated movable core 10, the pinion 6 is brought into engagement with the ring gear 7 of the internal combustion engine. The movable contact 25 is also brought into engagement with the fixed contacts 26 and 27, enabling current to be supplied to the electric motor 2.

The activation of the motor 2 causes the shaft of the internal combustion engine to be rotated by means of the pinion 6.

As soon as the rotation of the shaft of the internal combustion engine reaches the speed at which the engine can keep itself running, the comparator 37 indicates this condition to the control logic circuit 38.

FIG. 3 shows an example of a curve of the speed $\omega$ of the internal combustion engine. In this graph, the speed at which the engine can keep itself running is indicated $\omega_0$. This speed is reached at the moment indicated $t_1$ in FIG. 3.

During the starting stage, the curve of the angular velocity of the shaft of the internal combustion engine has alternating rising and falling portions which coincide, respectively, with the expansion and compression phases in the cylinders.

When the angular velocity of the shaft of the internal combustion engine reaches a value such that the engine can keep itself running, the control logic circuit 38 does not immediately cut off the current through the electronic switch 35 but waits until it receives from the comparator 40 the signal which indicates that the angular acceleration of the shaft is less than or equal to zero. This occurs, for example, at a subsequent moment, indicated $t_2$ in FIG. 3, which coincides with a phase in which the angular velocity of the shaft is falling.

The de-energising of the solenoid 11 of the electromagnet 3, and hence the disengagement of the pinion 6 from the flywheel 7 (caused by the return spring 17), take place in circumstances in which there is little stress in the mutual coupling between the pinion and the flywheel.

The disengagement of the pinion from the flywheel 7 thus takes place easily and quietly.

Naturally, the principle of the invention remaining the same, the forms of embodiment and details of construction may be varied widely with respect to those described and illustrated purely by way of non-limiting example, without thereby departing from the scope of the present invention.

Thus, although a solution with circuitry of a basically analogue type is described with reference to FIG. 2, the derivation of the speed signal, the comparison of the signal with a threshold, and the comparison of the angular acceleration of the engine shaft with a corresponding threshold may be performed by digital devices and methods, possibly with the use of a microprocessor.

I claim:

1. A starting system for an internal combustion engine, including:

a direct-current voltage supply, an electric starter motor for rotating a movable pinion, an electromagnetic operating device including a solenoid and an associated movable which, as a result of the passage of a current through the solenoid, can bring about:

a movement of the pinion towards a working position in which it can be coupled for rotation with a rotary member of the internal combustion engine, and the supply of current to the electric motor, sensor means for supplying an electrical signal indicative of the speed of rotation of the shaft of the internal combustion engine, and control means for controlling the connection of the electromagnetic operating device to the voltage supply the control means including comparator means which are arranged to compare the signal supplied by the sensor means with a predetermined threshold which corresponds to the speed at which the internal combustion engine can keep itself running, the control means being arranged:

to derive a signal indicative of the angular acceleration of the shaft of the internal combustion engine from the signal supplied by the sensor means, and to cut off the current supply to the solenoid of the electromagnetic operating device in operation, as soon as the speed of rotation of the engine shaft exceeds the threshold and the angular acceleration of the shaft is less than or equal to zero.

* * * * *